US008313879B2

(12) United States Patent
Kuramashi

(10) Patent No.: US 8,313,879 B2
(45) Date of Patent: Nov. 20, 2012

(54) FULL-COLOR TONER, IMAGE FORMING METHOD, AND IMAGE FORMING APPARATUS

(75) Inventor: Koji Kuramashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 568 days.

(21) Appl. No.: 12/463,525

(22) Filed: May 11, 2009

(65) Prior Publication Data

US 2010/0062354 A1 Mar. 11, 2010

(30) Foreign Application Priority Data

Sep. 10, 2008 (JP) ..... 2008-232246
Apr. 8, 2009 (JP) ..... 2009-093799

(51) Int. Cl.
*G03G 9/09* (2006.01)

(52) U.S. Cl. ..... 430/108.23; 430/107.1; 430/108.1; 430/123.5; 430/123.57; 399/231

(58) Field of Classification Search ..... 430/107.1, 430/108.1, 108.23, 123.5, 123.57; 399/231
See application file for complete search history.

(56) References Cited

U.S. PATENT DOCUMENTS 4,734,349 A * 3/1988 Chapman et al. ..... 430/108.23
2004/0136758 A1* 7/2004 Kera et al. ..... 399/299
2004/0137344 A1* 7/2004 Yamashita et al. ..... 430/45
2005/0095522 A1* 5/2005 Goebel et al. ..... 430/108.7
2006/0003247 A1* 1/2006 Baker et al. ..... 430/109.3
2006/0008721 A1* 1/2006 Hirai ..... 430/107.1

FOREIGN PATENT DOCUMENTS

JP 8-12465 2/1996
JP 2005-157342 6/2005

* cited by examiner

*Primary Examiner* — Peter Vajda
(74) *Attorney, Agent, or Firm* — Frommer Lawrence & Haug LLP

(57) ABSTRACT

A full-color toner set including a yellow component, a cyan component, and a magenta component, wherein in each of the color components, resin fine particles are added to a surface of base particles. Further, the yellow component may include a monoazo pigment serving as a colorant in the base particles. In addition, the following formulae (1) and (2) may be satisfied, where the amount of addition of the resin fine particles based on 100 parts by mass of base particles in the yellow component is represented by Wy, the amount of addition of the resin fine particles based on 100 parts by mass of base particles in the cyan component is represented by Wc, and the amount of addition of the resin fine particles based on 100 parts by mass of base particles in the magenta component is represented by Wm, $$Wy > Wc \quad (1)$$

$$Wy > Wm \quad (2).$$

16 Claims, 1 Drawing Sheet

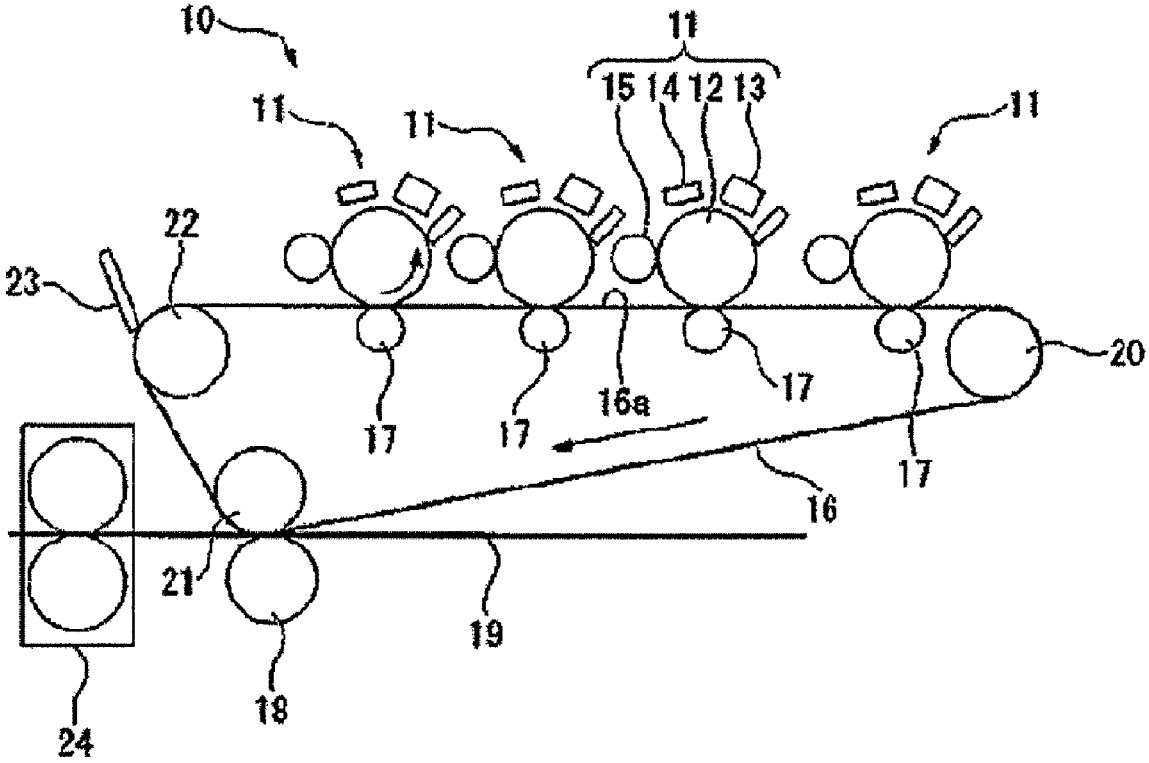
10
11
15 14 12 13
11
11
11
22
23
20
17
17
16a
17
17
16
21
19
18
24

FULL-COLOR TONER, IMAGE FORMING METHOD, AND IMAGE FORMING APPARATUS

INCORPORATION BY REFERENCE

This application is based upon and claims the benefit of priority from the corresponding Japanese Patent Applications No. 2008-232246, filed Sep. 10, 2008 and No. 2009-093799, filed Apr. 8, 2009, the entire contents of which are incorporated herein by reference.

FIELD OF THE INVENTION

The present invention relates to a full-color toner, an image forming method, and an image forming apparatus.

BACKGROUND OF THE INVENTION

Image forming apparatuses, e.g., full-color multifunction peripherals and printers, take advantage of electrophotography form individual color images by using full-color toners respectively, e.g., a yellow component, a cyan component, and a magenta component, and superimpose toner images of individual colors. In general, the toner includes base particles, which contain a colorant and additives in a binder resin. The toner may be used alone as a one-component developer or be used as a two-component developer in which the toner is added to a carrier. Such toners are required to improve the hue, the chroma, and the lightness of the individual color components of the toner in a balanced manner in order that images formed by using the toners exhibit color reproducibility with maximum faithfulness to original images.

Properties of a color component may depend upon the colorant used in the toner. For example, properties such as the hue, the chroma, and the lightness of the color component may be affected by the colorant used in the toner. Incidentally, the colorant may exert an influence on the charging properties of the toners of individual colors on the basis of specific structures and differences in compatibility with binder resins. Consequently, at initial stage of printing, the additives and the carriers deliver their functions sufficiently and the toner performance required in individual processes, e.g., development, transfer, and fixing, can be satisfied. However, in some cases where printing is repeated for a long term, the charging properties of specific color components of the toner deteriorate, image fogging and toner scattering occur, and defective images result.

In this regard, a method for suppressing deterioration in charging property of the toner by using an external additive on surface of the base particles has been known. In many cases, titanium oxide is usually used as the external additive. Furthermore, for the purpose of stabilizing the charging performance in repetition of copying for a long term or in a specific environment of high temperature and high humidity, low temperature and low humidity, or the like, a developer has been proposed, in which a positively chargeable silica fine powder or negatively chargeable, fluororesin-containing fine particles are used as external additives.

However, past use of this method has resulted in cloudy images and a deterioration of the color developing property. Moreover, the yellow component exhibits particularly high lightness among full-color toners and, therefore, color development of a formed image is susceptible to the external additives.

Consequently, a yellow component including a monoazo pigment has been proposed as a component of a toner exhibiting excellent color reproducibility, having good coloring power, and good charging properties.

However, a yellow component including the monoazo pigment tends to lose charging characteristic. The amount of charge of the yellow component may decrease because of a structural feature of the monoazo pigment. In particular, the amount of charge decreases significantly after printing repeatedly for a long term, that is, after the toner undergoes a long-term agitation operation in a developing unit or a toner container. Hence, when a full-color image is formed, a difference in amount of charge occurs between the yellow component and the other color components of the toner (cyan component and magenta component). As a result, differences in developing properties occur between the individual color components of the toner and the color reproducibility of the image formed using the toner relative to the original image tends to deteriorate.

SUMMARY OF THE INVENTION

In order to solve the above-described problems, it is an object of the present invention to provide a full-color toner set which exhibits excellent color reproducibility qualities and is capable of maintaining developing properties for long term use. Further, an embodiment may include an image forming method and an image forming apparatus which uses the full-color toner set.

An embodiment of a full-color toner set may include a yellow component, a cyan component, and a magenta component in combination. Some embodiments may include adding resin fine particles to base particles. In an embodiment, the yellow component may include a monoazo pigment serving as a colorant in the base particles. The following formulae (1) and (2) are satisfied, where the amount of resin fine particles added, based on 100 parts by mass of base particles in the yellow component is represented by Wy, the amount of the resin fine particles added, based on 100 parts by mass of base particles in the cyan component is represented by Wc, and the amount of the resin fine particles added, based on 100 parts by mass of base particles in the magenta component is represented by Wm.

$$Wy > Wc \quad (1)$$

$$Wy > Wm \quad (2)$$

In an embodiment, an image forming method and/or an image forming apparatus may include the above-described toner.

The above and other objects, features, and advantages of the present invention will be more apparent from the following detailed description of preferred embodiments taken in conjunction with the accompanying drawings.

In this text, the terms “comprising”, “comprise”, “comprises” and other forms of “comprise” can have the meaning ascribed to these terms in U.S. Patent Law and can mean “including”, “include”, “includes” and other forms of “include”.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWING

The following detailed description, given by way of example, but not intended to limit the invention solely to the specific embodiments described, may best be understood in conjunction with the accompanying drawing, in which:

FIG. 1 is a schematic configuration diagram showing an example of an image forming apparatus according to the present invention.

DETAILED DESCRIPTION OF THE PREFERRED EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

An embodiment of a full-color toner set may include a combination of at least a yellow component, a cyan component, and a magenta component (hereinafter referred to as "toner"). In some embodiments, a black component may be included in the toner. Each color component of the toner may include adding an external additive to the base particles. The external additive added to the base particles may adhere to surfaces of the base particles. In some embodiments, a portion of the external additive may not adhere to the base particles. Thus, in some embodiments, external additive may be present in the toner in a free state.

The base particles may include a binder resin and a colorant.

The binder resin may include, but is not limited to thermoplastic resins, e.g., polystyrene resins, polyester resins, acrylic resins, styrene-acrylic copolymers, polyethylene resins, polypropylene resins, vinyl chloride resins, polyamide resins, polyurethane resins, polyvinyl alcohol resins, vinyl ether resins, N-vinyl resins, and styrene-butadiene resins, any binder resin currently known or yet to be discovered in the art, or any combination of binder resins. In an embodiment, one or more polyester resins may be used as the binder resin. Examples of polyester resins may include, but are not limited to resins obtained through polycondensation of an alcohol component and a carboxylic acid component.

Colorants of individual colors used in the toner may vary. In some embodiments, the toner may have multiple color components including, but not limited to black, blue, brown, red, green, gray, magenta, light magenta, cyan, light cyan, orange, purple, white, yellow, any color known in the art, or combinations thereof. For example, a toner may have a yellow component, a cyan component, a magenta component, and a black component.

In some embodiments, the yellow component may include a monoazo pigment as the colorant. The monoazo pigment is a pigment with lightness and coloring power properties. By including the monoazo pigment, the lightness and the color developing property of the yellow component may be enhanced in some embodiments. As for the monoazo pigment, any known pigments can be used. In an embodiment, acetoacetanilide monoazo pigments represented by General formula (I) described below may be used.

(I)

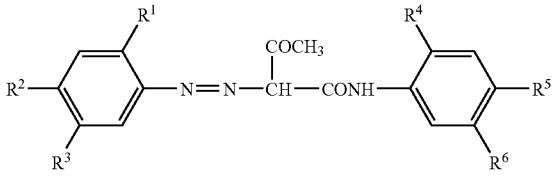

In General formula (I), R1 represents an alkyl group, an alkoxy group, or a nitro group, R2 represents a halogen atom, an alkyl group, an alkoxy group, a carboxy group, a nitro group, a sulfamoyl group substituted with an aromatic, or a sulfo group substituted with a metal, (e.g., Ca, Ba, Mn, and Sr), and R3 to R6 may independently represent a hydrogen atom, a halogen atom, an alkyl group, and/or an alkoxy group. In an embodiment, R3 to R6 may represent the same groups and/or atoms. Some embodiments may include different groups and/or atoms positioned at R3 to R6. Further, an embodiment may include repeated groups and/or atoms, as well as groups and/or atoms represented only once at positions R3 to R6.

Examples of acetoacetanilide monoazo pigments include, but are not limited to C. I. Pigment Yellow 1, C. I. Pigment Yellow 3, C. I. Pigment Yellow 65, C. I. Pigment Yellow 73, C. I. Pigment Yellow 74, C. I. Pigment Yellow 97, C. I. Pigment Yellow 98, C. I. Pigment Yellow 130, C. I. Pigment Yellow 133, and C. I. Pigment Yellow 169. In an embodiment, C. I. Pigment Yellow 74 may be used due to its color developing property. C. I. Pigment Yellow 74 is represented by General formula (II) described below.

(II)

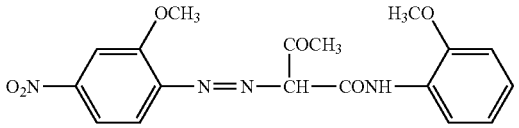

The monoazo pigment may be added in an amount ranging from about 1.0 to about 15.0 parts by mass. In alternate embodiments, the monoazo pigment may be added in an amount in a range from about 2.0 to about 8.0 parts by mass, based on 100 parts by mass of binder resin.

In some embodiments, the yellow component may include yellow pigments including, but not limited to inorganic pigments, e.g., yellow iron oxide, ocher, chrome yellow, zinc yellow, cadmium yellow, and antimony yellow; organic pigments, e.g., C. I. Pigment Yellow 16, C. I. Pigment Yellow 138, and Quinoline Yellow Lake; and dyes, e.g., C. I. Solvent Yellow 16, C. I. Solvent Yellow 33, C. I. Solvent Yellow 56, C. I. Solvent Yellow 60, C. I. Solvent Yellow 61, C. I. Solvent Yellow 162, C. I. Acid Yellow 1, and C. I. Acid Yellow 23 any known pigments in the art, or any combinations thereof. In some embodiments, yellow pigments may be added in an amount ranging from about 1.0 to about 15.0 parts by mass. An embodiment of the yellow component may include yellow pigments in a range from about 2.0 to about 8.0 parts by mass, based on 100 parts by mass of binder resin.

The cyan component may include a cyan pigment as the colorant. The cyan pigment may include, but is not limited to inorganic pigments, e.g., copper phthalocyanine pigments and partially chlorinated products thereof, metal-free phthalocyanine pigments, Prussian blue, and cobalt blue; organic pigments, e.g., C. I. Pigment Blue 18 and Heliogen Blue G; and dyes, e.g., C. I. Vat Blue 6 and C. I. Solvent Blue 70, any known pigments in the art, or any combinations thereof. The cyan pigment may be added in an amount ranging from about 1.0 to about 15.0 parts by mass. An embodiment of the cyan component may include cyan pigments in a range from about 2.0 to about 8.0 parts by mass, based on 100 parts by mass of binder resin.

The magenta component may include a magenta pigment as the colorant. The magenta pigment may include, but is not limited to inorganic pigments, e.g., red ion oxide, cadmium red, minimum, cadmium mercury sulfide, manganese violet, chrome orange, and molybdenum orange; organic pigments, e.g., C. I. Pigment Red 3, C. I. Pigment Red 38, C. I. Pigment Red 48:2, C. I. Pigment Red 49:1, C. I. Pigment Red 49:2, C. I. Pigment Red 50, C. I. Pigment Red 57, C. I. Pigment Red 60, C. I. Pigment Red 81, C. I. Pigment Red 90, Permanent Red FNG, C. I. Pigment Violet 3, C. I. Pigment Orange 5, C. I. Pigment Orange 13, and C. I. Pigment Orange 16; and dyes, e.g., Spilon Red, Fast Violet B, Indanthrene Brilliant Orange R, and Indanthrene Brilliant Orange GK, any known pigments in the art, or combinations thereof. In some embodiments, the magenta pigment may be added in an amount in a range from about 1.0 to about 15.0 parts by mass, based on 100 parts by mass of binder resin. In an embodiment, magenta pigment may be added in an amount in a range from about 2.0 to about 8.0 parts by mass, based on 100 parts by mass of binder resin.

Some embodiments may include a black component having black pigment as the colorant. The black pigment may include, but is not limited to carbon black and nigrosine based dyes and pigments; and magnetic particles of cobalt, nickel, triiron tetraoxide, manganese iron oxide, zinc iron oxide, and nickel iron oxide, any known pigments in the art, or any combination thereof. The black pigment may be added in an amount ranging from about 1.0 to about 15.0 parts by mass, based on 100 parts by mass of binder resin. In an embodiment, a black pigment may be added in an amount in a range from about 2.0 to about 8.0 parts by mass, based on 100 parts by mass of binder resin.

Colored components of toner may be combined in any manner to obtain a desired tint. For example, at least two types of kindred colors may be combined. Alternately, different series of colors may be used in combination.

In an embodiment, the base particles may include a charge control agent and wax. The charge control agent may control the triboelectric charging characteristic of a toner, and a charge control agent for positive charge control and/or negative charge control is used in accordance with the charge polarity of the toner. The type of the charge control agent may include any charge control agent known or yet to be developed in the art. Examples of charge control agents exhibiting a positive charging property may include, but are not limited to resin type charge control agents in which amine compounds are bonded to nigrosine, quaternary ammonium salt compounds, and resins. In some embodiments, a colorless or white charge control agent may be used. For example, a colorless charge control agent may be used in a color component of toner. The charge control agent may be added in an amount ranging from about 0.1 to about 10.0 parts by mass, based on 100 parts by mass of binder resin. An embodiment may include charge control agent in a range from about 0.5 to about 5.0 parts by mass, based on 100 parts by mass of binder resin.

In some embodiments, the wax may include, but is not limited to vegetable wax such as carnauba wax, sugar wax, and wood wax; animal wax such as beeswax, insect wax, whale wax, and wool wax; and synthetic hydrocarbon wax such as Fischer-Tropsch (hereafter may be referred to as "FT") wax having an ester in a side chain, polyethylene wax, and polypropylene wax, any other wax known in the art or combinations thereof. For example, the FT wax having an ester in a side chain may be used in some embodiments. Further, polyethylene wax may be used. In an embodiment, the wax may be added in an amount ranging from about 0.5 to about 15.0 parts by mass based on 100 parts by mass of binder resin. Further, some embodiments may include wax in a range from about 1.0 to about 10.0 parts by mass, based on 100 parts by mass of binder resin.

The base particles may be produced by a method including, but not limited to a kneading and pulverization method, a polymerization method, a spinning method, any method known in the art, or combinations thereof. In some embodiments, when producing base particles using the kneading and pulverization method necessary raw materials may be mixed together and pulverized. For example, necessary raw materials, such as binder resin, colorant, charge control agent, and wax, may be mixed with a mixer. In some embodiments, the mixer may be a Henschel mixer. In an embodiment, melt-mixing may be conducted with a twin screw extruder or the like. Pulverization may be conducted with a pulverizer including, but not limited to a pneumatic pulverizer, a jet air pulverizer; a mechanical pulverizer, a mill, a hammer mill, a jet pulverizer mill, a microjet mill, a ball mill, a tube mill, a ring and ball mill, a single mill, a twin mill, or any pulverizer currently known or yet to be discovered in the art. Classification of the base particles may allow different color components to be produced. In some embodiments, classification may be conducted with a classifier including, but not limited to a particle sizing and/or counting analyzer, such as a pneumatic classifier.

The produced base particles have the volume average particle diameter in a range from about 3.0 to about 10.0 μm. Regarding the volume average particle diameter of the base particles, the particle size distribution of the base particles is measured by using a particle size distribution measuring equipment including, but not limited to particle sizing and/or counting analyzers, such as a Multisizer™ 3 Coulter Counter® produced by Beckman Coulter, Inc. In some embodiments, the particle size distribution may be measured using an aperture diameter of about 100 μm. Alternately, other aperture diameters may be used. The average particle diameter is expressed by the value calculated from the obtained measurement value.

In an embodiment, resin fine particles may be externally added to the base particles. The resin fine particles may be colorless or white. In some embodiments, adding the resin fine particles may enhance a charge maintaining characteristic, a characteristic of a toner to maintain the amount of charge of the toner at a predetermined value, without affecting the tint of the toner. Thus, in an embodiment adding the resin fine particles to the external surface of the base particles may inhibit changes to the image density and image fogging of the image formed by using the toner. In some embodiments, the amount of charge of the toner may be ensured by maintaining a charge on the surface portion of the toner. The charge maintaining characteristic of the toner including the resin fine particles may be improved by increasing the specific surface area of the toner through addition of resin fine particles having a high charge maintaining property on the surfaces of the base particles. Incidentally, the "fine particle" may refer to a particle having a particle diameter smaller than that of the base particle.

In general, in order to inhibit the deterioration in a charging maintaining characteristic of the toner, titanium oxide may be used as an additive on a surface of the base particles. In some embodiments, large amounts of titanium oxide may be added. An amount of titanium oxide added may vary depending on the properties of the toner. For example, properties of the toner, such as durability and the like, may be considered when determining an amount of titanium oxide to be added. In some embodiments, a charge maintaining characteristic of the toner may be improved by using resin fine particles as an external additive on the base particles. In some embodiments, titanium oxide may be used in combination with resin fine particles. Use of resin fine particles with titanium oxide may decrease an amount of titanium oxide utilized. In an embodiment, reducing an amount of titanium oxide may reduce clouding in the image and deterioration in the color developing properties of the toner.

Resin fine particles may include, but are not limited to thermoplastic resins, e.g., polystyrene resins, polyester resins, acrylic resins, styrene-acrylic copolymers, polyethylene resins, polypropylene resins, vinyl chloride resins, polyamide resins, polyurethane resins, polyvinyl alcohol resins, vinyl ether resins, N-vinyl resins, and styrene-butadiene resins, any binder resin currently known or yet to be discovered in the art, or any combination thereof. In some embodiments, styrene-acrylic copolymers may be used. In an embodiment, the resin fine particles may include the same type of resin as the binder resin or be a different type of resin.

In an embodiment, the yellow component may include resin fine particles, such as an acrylate monomer having an isobornyl group and a styrene monomer (hereafter referred to as an "isobornyl-containing styrene acrylic copolymer"). In some embodiments, the yellow component may include a monoazo pigment as a colorant. The monoazo pigment has both a electron donor group and a electron acceptor group in a molecule. In an embodiment, an amount of charge of the yellow component may be lower than the charge of the other color components, such as the cyan component, the magenta component and/or the black component. An embodiment may include using resin fine particles as an additive on an external surface of the base particles to maintain the amount of charge of the color component. In an embodiment, may include isobornyl-containing styrene acrylic copolymer. The isobornyl-containing styrene acrylic copolymer has high mechanical strength and does not melt easily. This may reduce adhesion of the resin fine particles to a photoconductor in the development process and thus may reduce deficiencies in the image. In some embodiments, isobornyl-containing styrene acrylic copolymer may be used as the resin fine particle for the yellow component to maintain a charge of the yellow component.

Resin fine particles used for individual color components may be different. In an embodiment, the same resin fine particle used in each color component of the toner may be the same. Using the same resin fine particle in each of the color components of the toner may promote maintaining an amount of charge in the toner.

Resin fine particles may be added in an amount ranging from about 0.01 about to 5.0 parts by mass, based on 100 parts by mass of base particles. In some embodiments, resin fine particles may be added in an amount ranging from about 0.05 to about 2.0 parts by mass, based on 100 parts by mass of base particles. Charge maintaining characteristic of toner and its components tends to be enhanced as the amount of the resin fine particles added increases. In some embodiments, the volume average particle diameter is in a range from about 0.10 to about 2.0 μm. Further, some embodiment may include resin fine particles having a volume average particle diameter in a range from about 0.05 to about 1.0 μm. The volume average particle diameter of the resin fine particles may be measured in a manner similar to that of the average particle diameter of the base particles.

In an embodiment, additives may include, but are not limited to silica, alumina, magnetite, tin oxide, titanium oxide, and strontium oxide. Some embodiments may include an additive and resin fine particles used in combination. Additives may be selected based on the properties of the toner. Additives may be added to the base particles in an amount ranging from about 0.01 to about 5.0 parts by mass, based on 100 parts by mass of base particles. Some embodiments include additives in the base particles in an amount ranging from about 0.05 to about 2.0 parts by mass, based on 100 parts by mass of base particles.

The toner may be obtained by adding the additive or additives to the base particles in accordance with the above-described individual color components and mixing. The thus obtained toner may be used alone as a one-component developer or be used as a two-component developer in combination with a carrier. In an embodiment where the toner is combined with the carrier, the toner may be added to the carrier in an amount ranging from about 3.0 to about 20.0 parts by mass, based on 100 parts by mass of carrier. In an embodiment where the toner is combined with the carrier, the toner may be added to the carrier in an amount ranging from about 5.0 to about 15.0 parts by mass, based on 100 parts by mass of carrier.

Carriers may include, but are not limited to particles of magnetic substances, resin particles in which magnetic substances are dispersed in binder resins, carriers known in the art and/or combinations thereof. Magnetic substances include, but are not limited to magnetic metals, such as iron, nickel, and cobalt, alloys thereof, alloys containing rare earths, iron based oxides, such as hematite, magnetite, manganese-zinc based ferrite, nickel-zinc based ferrite, manganese-magnesium based ferrite, lithium based ferrite, other soft ferrite, and copper-zinc based ferrite, and mixtures thereof. Binder resins for use in the carriers may include, but are not limited to vinyl resins, polyester resins, epoxy resins, phenol resins, urea resins, polyurethane resins, polyimide resins, cellulose resins, polyether resins, and mixtures thereof. The particles of magnetic substances can be produced by known methods including, but not limited to a sintering method and an atomizing method. In some embodiments, the carrier may include a coating of a resin layer on the surface of the carrier.

In an embodiment, a full-color toner set may include a combination of at least three color components of the toner. For example, a toner may include a yellow component, a cyan component and a magenta component. Each toner constituting the full-color toner set described above satisfies the following formulae (1) and (2), where the amount of the resin fine particles added based on 100 parts by mass of base particles is represented by W.

$$Wy>Wc \quad (1)$$

$$Wy>Wm \quad (2)$$

In the formulae (1) and (2), Wy, Wc, and Wm represent the amounts of resin fine particles added based on base particles in the yellow component, the cyan component, and the magenta component, respectively. The charge maintaining characteristic of the toner may be enhanced as the amount resin fine particles added increases. Among the toners of three colors satisfying the formulae (1) and (2), the charge maintaining characteristic of the yellow component is most favorably maintained. In some embodiments, a ratio of Wy/Wc is in a range from about 1.1 to about 5.0. In addition, an embodiment may include a ratio of Wy/Wm in a range from about 1.1 to about 5.0.

In some embodiments, the yellow component may include a monoazo pigment as a colorant. The monoazo pigment has both a electron donor group and a electron acceptor group in a molecular. In an embodiment, an amount of charge of the yellow component may be lower than the charge of the other color components, such as the cyan component, the magenta component and/or the black component. An amount of charge may decrease after printing is conducted repeatedly for a long term. This loss of charge when a full-color image is formed may cause a difference in amount of charge between the color components of the toner. For example, the charge maintaining characteristic of the yellow component may differ from the charge maintaining characteristic of the other color components of the toner (e.g., cyan component and magenta component). As a result, differences in developing property occur between color components of the toner, and the color reproducibility of the image formed by using the toner set tends to deteriorate relative to the original image.

To maintain the charge of the various color components of the toner, formulae (1) and (2) may be used. Utilizing formulae (1) and (2) may reduce the difference in charge maintenance characteristics of the various color components of the toner. This may reduce deterioration in color reproducibility during repetitive, long term printing.

In the above-described formula (1), a value for Wy may be in a range from about 1.1 to about 5.0 times the value of Wc. Some embodiments may include Wy having a value in a range from about 1.5 to about 3.0 times the value of Wc. If a value of Wy is smaller than about 1.1 times a value of Wc, the charge maintaining characteristic of the yellow component may differ from the charge maintaining characteristic of the cyan component. On the other hand, if a value of Wy exceeds 5.0 times a value of Wc, fixation of an image may become insufficient. For example, fixation of the image to paper may be insufficient.

In the above-described formula (2), a value for Wy may be in a range from about 1.1 to about 5.0 times a value of Wm. Some embodiments may include Wy having a value in a range from about 1.5 to about 3.0 times the value of Wm. If a value of Wy is smaller than about 1.1 times a value of Wm the charge maintaining characteristic of the yellow component may differ from the charge maintaining characteristic of the magenta component. This may allow a decrease in amount of charge of the yellow component to be larger than that a decrease in the charge of the magenta component. On the other hand, if Wy exceeds 5.0 times Wm, fixation of an image may become insufficient. For example, fixation of the image to paper may be insufficient.

In this regard, the relationship between Wc and Wm is not specifically limited, and Wc=Wm may be satisfied, Wc>Wm may be satisfied, or Wc<Wm may be satisfied. In an embodiment utilizing a black component in combination with a full-color toner set formula (3) may be used. For example, a black component may be used in combination with a full-color toner set having a yellow component, a cyan component and a magenta component and satisfying formula (3). When using a full-color toner set, in some embodiments the yellow component and the black component may satisfy the following formula (3). Wk refers to the amount of resin fine particles in the black component, based on 100 parts by mass of base particles.

$$Wy>Wk \quad (3)$$

In some embodiments, the full-color toner set may be used for an apparatus to form a full-color image. For example, the full-color toner set may be used with an image forming apparatus adopting a tandem development system or an image forming apparatus adopting a rotary development system.

In some embodiments, the full-color toner set may include base particles and resin fine particles. For example, resin fine particles may be added to the color components of the toner. The color components and the resin fine particles may be combined in a manner that allows the individual color components to satisfy the above-described formulae (1) and (2). Thus, the amount of charge may be maintained within a range without impairing excellent lightness and color developing property of the yellow component including the monoazo pigment. Therefore, the embodiments described herein may suppress clouding of a formed image. In addition, a balance between the amounts of charge of the yellow component and the other color components (e.g., cyan component and magenta component) may result. Hence, deterioration in color reproducibility of the formed image relative to the original image may be inhibited because the good developing properties of the toner can be maintained for long term printing.

In some embodiments, an image forming method may include charging a image carrier by a charging unit, forming an electrostatic latent image on the above-described charged image carrier by an exposing unit, developing the above-described electrostatic latent image to a toner image with a developer from a developing unit, and transferring the above-described toner image to a recording medium by a transferring unit. In some embodiments of the method, a toner set including toners of at least three colors (e.g., a yellow component, a cyan component, and a magenta component) may be used as a developer. Full-color images may be formed by superimposing toner images formed by the individual color components. In each of the color components of the toner, resin fine particles serving as an external additive are added to base particles which may also include a binder resin and a colorant. Moreover, the following formulae (1) and (2) may be satisfied, where the amount of addition of the resin fine particles based on 100 parts by mass of base particles is represented by W. In addition, the yellow component may include a monoazo pigment serving as a colorant.

$$Wy>Wc \quad (1)$$

$$Wy>Wm \quad (2)$$

In the formulae (1) and (2), Wy, Wc, and Wm represent the amounts of resin fine particles added to the yellow component, the cyan component, and the magenta component, respectively, based on 100 parts by mass of base particles.

When the compositions of the color components of the toner satisfy the relationships set out in formulae (1) and (2) the amount of charge of the yellow component can be favorably maintained. Generally, the amount of charge of the yellow component tends to decrease as compared with that of the other color components. Consequently, the difference in amount of charge between the color components may become small, thereby reducing the deterioration in color reproducibility of the image after long-term printing.

Some embodiments include toners having three colors which satisfy the above-described formulae (1) and (2). In these embodiments, the three color components used in the full-color toner set may include the yellow component, the cyan component, and the magenta component. Furthermore, in the image forming method, besides the above-described toners of three colors an additional fourth color may be used. For example, the black component may be used in combination with the full-color toner set.

In some embodiments, the full-color toner set may include base particles and resin fine particles. For example, resin fine particles may be added to the color components of the toner. The color components and the resin fine particles may be combined in a manner that allows the individual color components to satisfy the above-described formulae (1) and (2). Thus, the amount of charge may be maintained within a range without impairing lightness and color developing properties of the yellow component including the monoazo pigment. The embodiments described herein may suppress clouding of a formed image. In addition, a balance between the amounts of charge of the yellow component and the other color components (e.g., cyan component and magenta component) may result. Hence, deterioration in color reproducibility of the formed image relative to the original image may be inhibited because the good developing properties of the toner can be maintained for long term printing.

Regarding the above-described image forming method, resin fine particles may be used as an additive added to the base particles. In addition, the color components (e.g., yellow component, cyan component, and magenta component) are used while the amounts of resin fine particles added in individual color components may satisfy the above-described formulae (1) and (2). Consequently, the amount of charge of the yellow component can be maintained without impairing lightness and color developing properties of the yellow component which includes the monoazo pigment. The embodiments described herein may suppress clouding of a formed image. In addition, a balance between the amounts of charge of the yellow component and the other color components (e.g., cyan component and magenta component) may result. Hence, deterioration in color reproducibility of the formed image relative to the original image may be inhibited because of the good developing properties of the toner can be maintained for long term printing.

The image forming apparatus may form a full-color image using a toner with multiple color components. For example, a toner may have at least three color components (e.g., a yellow component, a cyan component, and a magenta component) and superimposing toner images formed by the individual color components. In some embodiments, a black component may be used in combination with the yellow component, the cyan component and the magenta component.

Here, an example of the image forming apparatus will be described in detail with reference to the drawing. FIG. 1 is a schematic configuration showing a key portion of a tandem type full-color image forming apparatus (hereafter referred to as simply "image forming apparatus") 10. This image forming apparatus 10 includes image forming units 11. Each image forming units 11 may correspond to individual colors, for example yellow (Y), magenta (M), cyan (C), and black (BK).

Image forming unit 11 may be configured to include photoconductor 12 serving as a image carrier on which a toner image is formed, charging unit 13, exposing unit 14, and developing unit 15. Toner may be held in developing unit 15. Examples of photosensitive layers of photoconductor 12 include amorphous silicon photoconductors or organic photoconductors. In each image forming unit 11, a surface of photoconductor 12 charged with charging unit 13 is exposed to light in accordance with the image data from exposing unit 14 and, thereby, an electrostatic latent image is formed on the surface of photoconductor 12. The resulting electrostatic latent image is developed by using the toner held in developing unit 15 and, thereby, the electrostatic latent image on photoconductor 12 is converted to a toner image.

Furthermore, image forming apparatus 10 includes intermediate transfer member 16, to which the toner image formed on photoconductor 12 is transferred. Intermediate transfer member 16 also functions as a recording medium. The toner image formed on photoconductor 12 may be transferred to a surface of intermediate transfer member 16, i.e., transfer surface 16*a*, by the operation of primary transfer rolls 17 disposed facing the individual image forming units 11. That is, a full-color toner image is formed on transfer surface 16*a* by putting the timing for forming the toner image between each individual image forming units 11. Furthermore, the full-color toner image transferred to transfer surface 16*a* of intermediate transfer member 16, as described above, is secondarily transferred to recording medium 19, e.g., paper, by the operation of secondary transfer roll 18. In this regard, primary transfer rolls 17 and secondary transfer roll 18 constitute the transfer portion.

In the drawing, reference numeral 20 denotes driving roll of the intermediate transfer member 16, reference numeral 21 denotes backup roll of the secondary transfer roll 18, reference numeral 22 denotes a tension roll, reference numeral 23 denotes cleaning blade of the intermediate transfer member 16, and reference numeral 24 denotes a fixing unit. Recording medium 19 undergoes operations of heat and pressure in fixing unit 24, and the full-color toner image secondarily transferred to recording medium 19 is fixed to recording medium 19. Subsequently, recording medium 19, to which the full-color toner image has been fixed in fixing unit 24, is discharged into an output tray, although not shown in the drawing, disposed in image forming apparatus 10.

In some embodiments four color components may be held in developing unit 15 of the individual image forming units 11. Color components (e.g., the yellow component, the cyan component, and the magenta component) may include resin fine particles on a portion of an external surface of the base particles, which may include a binder resin and a colorant. Furthermore, the following formulae (1) and (2) are satisfied, where the amount of the resin fine particles based on 100 parts by mass of base particles is represented by W. In some embodiments, the yellow component may include a monoazo pigment serving as a colorant.

$$Wy > Wc \quad (1)$$

$$Wy > Wm \quad (2)$$

In the formulae (1) and (2), Wy, Wc, and Wm represent the amounts of resin fine particles added to each of the color components based on base particles in the yellow component, the cyan component, and the magenta component, respectively.

Since in an embodiment the three color components may be selected to satisfy the formulae (1) and (2), the amount of charge of the yellow component can be favorably maintained. Generally, an amount of charge of the yellow component may decrease as compared with that of the other color components. Consequently, the difference in amount of charge between the different color components of the toner becomes small, so that deterioration in color reproducibility of the image formed using the toner relative to the original image can be suppressed even after printing repeatedly for a long term.

Some embodiments include a full-color toner set which satisfies the above described formulae (1) and (2) and include a yellow component, a cyan component, and a magenta component. In further embodiments, a full-color toner set may be used in combination with a black component.

An embodiment of the image forming apparatus may include using toner having three color components. The color components may include base particles to which resin fine particles have been added in a manner to allow the formulae (1) and (2) to be met. An embodiment may include adding the resin fine particles to the base particles such that the resin fine particles cover at least a portion of an external surface of the base particles. Thus, the yellow component can maintain a charge without impairing properties of the yellow component of the toner. For example, the shading properties and color developing properties of a yellow component which includes monoazo pigment will be maintained. Therefore, toners having full-color sets which satisfy formulae (1) and (2) may suppress the clouding of a formed image. Further, a balance between a charge of the yellow component and the toners (e.g., cyan component and magenta component) other than the yellow component can be ensured. Hence, deterioration in the color reproducibility of the formed image can be suppressed since good developing properties of the toner can be maintained for long term use.

An embodiment of the image forming apparatus may include the above-described tandem development system. Alternately, an embodiment may include any development system known in the art, for example, an apparatus adopting a rotary development system.

EXAMPLES

Embodiments of the present invention will be described below with reference to examples, although the present invention is not limited to the following examples. In the following description, "part" and "%" refer to "part by mass" and "percent by mass", respectively.

Production of Resin Fine Particles

A 2-liter separable flask provided with an agitator, a thermometer, a nitrogen introduction tube, a reflux cooler, and a dropping funnel was prepared. 100 parts of ion-exchanged water and 1 part of lauric diethanolamide were put into the flask, and the temperature in the flask was raised to 80° C. Thereafter, 0.1 parts of 2,2'-azobis(2-methylpropionamidine) dihydrochloride was added into the flask. Furthermore, 40 parts of styrene, 30 parts of isobornyl acrylate, and 30 parts of butyl methacrylate were dropped into the flask. Subsequently, the temperature in the flask was kept at 80° C. for 3 hours so as to effect polymerization. After the resulting liquid was refined with an ultrafiltration apparatus, drying was conducted with SprayDry, so that resin fine particles having a glass transition temperature (Tg) of 150° C. were prepared.

Example 1

Production of Toner

Yellow Toner

A mixture prepared by adding 4 parts of C. I. Pigment Yellow 74 ("Sico Yellow FR1252" produced by BASF) serving as a colorant, 2 parts of quaternary ammonium salt compound ("Bontron P-51" produced by Orient Chemical Industries, Ltd.) serving as a charge control agent, and 3 parts of Fischer-Tropsch wax ("FT-100" produced by NIPPON SEIRO CO., LTD.) serving as wax to 100 parts of polyester resin produced through condensation of bisphenol and fumaric acid. These components were put into a Henschel mixer (produced by MITSUI MINING COMPANY, LIMITED), and mixed for 2 minutes. Thereafter, the above-described mixture was put into a twin screw extruder and melt-kneading was conducted to prepare a toner kneaded product. The resulting toner kneaded product was pulverized by using a pneumatic pulverizer. A classification treatment was conducted using an air classifier. As a result, base particles having a volume average particle diameter of 8 μm were obtained. Regarding the volume average particle diameter of the base particles, the particle size distribution of the base particles is measured by using a particle size distribution measuring device (e.g., "Multisizer 3" manufactured by Beckman Coulter, Inc.). During measurements the aperture diameter was set to 100 μm. The average particle diameter is expressed by the value calculated from the obtained measurement value.

A mixture prepared by adding 0.5 parts of resin fine particles was prepared as described above, 1.0 part of silica particle ("TG-820" produced by Cabot) and 1.0 part of titanium oxide ("TTO-55A" produced by ISHIHARA SANGYO KAISHA, Ltd.) serving as additives to 100 parts of the resulting base particles. The mixture was put into a Henschel mixer and mixed at 3,000 rpm for 10 minutes. The resulting yellow component and a ferrite carrier ("EF-60B" produced by Powdertech Co., Ltd., average particle diameter: 60 μm) were put into a Henschel mixer (produced by MITSUI MINING COMPANY, LIMITED) in such a way that the toner concentration relative to the carrier was 8%. The mixture was homogeneously agitated to prepare a two-component developer.

The calculation of the amount of resin fine particles added and the identification of the resin fine particle and the colorant were conducted as described below. Regarding the amount of resin fine particles added, the number and the area of the resin fine particles were measured by using a scanning electron microscope (SEM) photograph of toner surface. Further, statistical calculations were conducted. Whether the resin fine particle was an isobornyl-containing styrene-acrylic copolymer or not was identified on the basis of an infrared spectroscopic analysis of the toner. Regarding the identification of the colorant, the toner was dissolved into a solvent, an insoluble portion was separated, and identification was conducted on the basis of the infrared spectroscopic analysis.

A cyan component was prepared as in the case of yellow component except that 4 parts of C. I. Pigment Blue 15-3 ("Heliogen Blue D7079" produced by BASF) serving as the colorant was used instead of C. I. Pigment Yellow 74 and the amount (Wc) of resin fine particles added was changed to 0.4 parts. The resulting cyan component and the ferrite carrier ("EF-60B" produced by Powdertech Co., Ltd., average particle diameter: 60 μm) were put into the Henschel mixer (produced by MITSUI MINING COMPANY, LIMITED) in such a way that the toner concentration relative to the carrier was 8% and were homogeneously agitated and mixed so as to prepare a two-component developer.

Magenta Component

A magenta component was prepared as in the case of yellow component except that 4 parts of C. I. Pigment red 122 ("Pv Fast Red 3B" produced by Clariant) serving as the colorant was used instead of C. I. Pigment Yellow 74 and the amount (Wm) of resin fine particles added was changed to 0.4 parts. The resulting magenta component and the ferrite carrier ("EF-60B" produced by Powdertech Co., Ltd., average particle diameter: 60 μm) were put into the Henschel mixer (produced by MITSUI MINING COMPANY, LIMITED) in such a way that the toner concentration relative to the carrier was 8% and were homogeneously agitated and mixed so as to prepare a two-component developer.

Procedure

A color copier "KM-3232" (amorphous silicon photoconductor-equipped) produced by KYOCERA MITA Corporation was modified and was used as an evaluation machine. Developers in accordance with the resulting toners of three colors were put into developing units in accordance with individual colors of this evaluation machine. The power supply of the evaluation machine was turned on in an environment of ambient temperature and room humidity (temperature: 23° C., relative humidity: 50% RH). After initial setting of the evaluation machine was finished, a sample image was output, and this was assumed to be an initial image. The sample image was provided with places at which secondary color solid (Red, Green) by using the yellow component and blank paper portion were able to be measured, and each of L*1 (lightness), a*1 (hue and chroma), and b*1 (hue and chroma) of the secondary color solid (Red, Green) in which solid images of toners of two colors were superimposed was measured by using a Macbeth reflection densitometer ("RD-191" manufactured by GretagMacbeth). Next, a test, in which an image having a printed coverage rate of 2% was formed on a recording medium in an environment of ambient temperature and room humidity, was conducted 10,000 times repeatedly (continuous printing test). Thereafter, a sample image was output as in the above description, and it was assumed to be an image after test. Regarding the image after test, each of L*2, a*2, and b*2 of the secondary color solid (Red, Green) was measured in a manner similar to that for the initial image. The two images (e.g, the initial image and the sample image) were compared using ΔE, a method of measuring color difference commonly known in the art. ΔE (i.e., the difference in tint between the initial image and the image after test) of each secondary color solid (Red, Green) was determined on the basis of the following formula:

$$\Delta E=\{(L^*2-L^*1)2+(a^*2-a^*1)2+(b^*2-b^*1)2\}^{1/2}$$

L=Lightness a=Hue and Chroma b=Hue and Chroma

The case where the value of ΔE was 5 or less was evaluated as acceptable. The results are shown in Table 1 (infra).

Furthermore, regarding the image after test, the fogging density (FD) due to the yellow component was measured by using the Macbeth reflection densitometer, and the case where FD was 0.008 or less was evaluated as acceptable. The results are shown in Table 1.

Moreover, the image after test was visually evaluated. The case where there was no quality problem was indicated by "○", and the case where the image quality deteriorated because of deterioration in color reproducibility, image fogging, or the like was indicated by "x", where "○" indicates that the result was evaluated as acceptable. The results are shown in Table 1.

Example 2

Individual color components of the toner were prepared as in Example 1 except that the amount (Wy) of resin fine particles added based on the base particles in the yellow component was changed to 0.6 parts, and evaluation was conducted. The results are shown in Table 1.

Example 3

Individual color components of the toner were prepared as in Example 1 except that the amount (Wy) of resin fine particles added based on the base particles in the yellow component was changed to 0.6 parts and the amounts (Wc, Wm) of resin fine particles added based on the base particles in the cyan component and the magenta component were changed to 0.2 parts, and evaluation was conducted. The results are shown in Table 1.

Example 4

Individual color components of the toner were prepared as in Example 1 except that the amount (Wy) of resin fine particles added based on the base particles in the yellow component was changed to 0.2 parts and the amounts (Wc, Wm) of resin fine particles added based on the base particles in the cyan component and the magenta component were changed to 0.1 parts, and evaluation was conducted. The results are shown in Table 1.

Example 5

Individual color components of the toner were prepared as in Example 1 except that the amount (Wy) of resin fine particles added based on the base particles in the yellow component was changed to 1.0 part and the amounts (Wc, Wm) of resin fine particles added based on the base particles in the cyan component and the magenta component were changed to 0.6 parts, and evaluation was conducted. The results are shown in Table 1.

Comparative Example 1

Individual color components of the toner were prepared as in Example 1 except that the amount (Wy) of resin fine particles added based on the base particles in the yellow component was changed to 0.4 parts, and evaluation was conducted. The results are shown in Table 1.

Comparative Example 2

Individual color components of the toner were prepared as in Example 1 except that the amount (Wy) of resin fine particles added based on the base particles in the yellow component was changed to 0.3 parts, and evaluation was conducted. The results are shown in Table 1.

Comparative Example 3

Individual color components of the toner were prepared as in Example 1 except that the amounts (Wy, Wc, Wm) of resin fine particles added based on the base particles in the yellow component, the cyan component, and the magenta component were changed to 0.5 parts, and evaluation was conducted. The results are shown in Table 1.

Comparative Example 4

Individual color components of the toner were prepared as in Example 1 except that the amount (Wy) of resin fine particles added based on the base particles in the yellow component was changed to 0.2 part, the amounts (Wc) of resin fine particles added based on the base particles in the cyan component was changed to 0.4 parts and the amounts (Wm) of resin fine particles added based on the base particles in the magenta component was changed to 0.1 parts, and evaluation was conducted. The results are shown in Table 1.

Comparative Example 5

Individual color components of the toner were prepared as in Example 1 except that the amount (Wy) of resin fine particles added based on the base particles in the yellow component was changed to 0.2 part, the amounts (Wc) of resin fine particles added based on the base particles in the cyan component was changed to 0.1 parts and the amounts (Wm) of resin fine particles added based on the base particles in the magenta component was changed to 0.4 parts, and evaluation was conducted. The results are shown in Table 1.

TABLE 1

| | Wy (parts by mass) | Wc (parts by mass) | Wm (parts by mass) | $\Delta E_{red}$ | $\Delta E_{green}$ | Fogging density | Visual evaluation |
|---|---|---|---|---|---|---|---|
| Example 1 | 0.5 | 0.4 | 0.4 | 3.82 | 2.21 | 0.003 | ○ |
| Example 2 | 0.6 | 0.4 | 0.4 | 2.14 | 3.12 | 0.001 | ○ |
| Example 3 | 0.6 | 0.2 | 0.2 | 1.88 | 2.64 | 0.002 | ○ |
| Example 4 | 0.2 | 0.1 | 0.1 | 1.99 | 3.28 | 0.003 | ○ |
| Example 5 | 1 | 0.6 | 0.6 | 3.66 | 4.01 | 0.000 | ○ |
| Comparative example 1 | 0.4 | 0.4 | 0.4 | 6.11 | 7.75 | 0.004 | X |
| Comparative example 2 | 0.3 | 0.4 | 0.4 | 11.97 | 10.34 | 0.013 | X |
| Comparative example 3 | 0.5 | 0.5 | 0.5 | 9.19 | 9.03 | 0.001 | X |
| Comparative example 4 | 0.2 | 0.4 | 0.1 | 3.63 | 8.44 | 0.003 | X |
| Comparative example 5 | 0.2 | 0.1 | 0.4 | 7.89 | 3.22 | 0.004 | X |

As shown in Table 1, scenarios (e.g., Examples 1-5) in which the color components of the toner satisfy the above-described formulae (1) and (2) inhibit degradation of print quality. Even after printing 10,000 times, an image exhibiting the lightness and the hue equivalent to those of the initial printing was able to be formed.

Comparative examples 1 to 3, each ΔE exhibited a large value as compared with those of shown in Examples 1-5. Therefore, the color reproducibility deteriorated in the Comparative Examples. Comparative examples 1 and 2 differed from the Examples in that the amount of charge of the yellow component was reduced because of continuous image formation. This, in turn reduced the lightness (L*2). In particular in Comparative example 2, the amount of charge of the yellow component was reduced significantly as compared with that in Comparative example 1. Thus, toner scattering and image fogging occurred. Furthermore, regarding Comparative example 3, it is believed that the amounts of charge of the cyan component and the magenta component exceeded the preferable ranges and, thereby, the developing properties of these color components deteriorated and the chroma (a*2, b*2) was reduced. Regarding Comparative example 4, ΔE (green) exhibited a large value as compared with those of the Examples and, therefore, the color reproducibility deteriorated. In Comparative example 4, the amount of charge of the cyan component was increased because of continuous image formation and, thereby, the developing properties of cyan component appeared to have deteriorated. Regarding Comparative example 5, ΔE (red) exhibited a large value as compared with those of Examples and, therefore, the color reproducibility deteriorated. In Comparative example 5, the amount of charge of the magenta component was increased because of continuous image formation and, thereby, the developing properties of cyan component appeared to have deteriorated.

Having thus described in detail preferred embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A full-color toner set comprising:

a yellow component comprising a monoazo pigment;

a cyan component; and a magenta component;

wherein each component comprises:

base particles; and resin fine particles added to at least a portion of an external surface of the base particles, wherein an amount of charge of the yellow component is substantially the same as that of each of the cyan and the magenta components, and formulae (1) and (2) are satisfied, wherein the amount of the resin fine particles based on 100 parts by mass of base particles in the yellow component is represented by Wy, the amount of the resin fine particles based on 100 parts by mass of base particles in the cyan component is represented by We; and the amount of the resin fine particles based on 100 parts by mass of base particles in the magenta component is represented by Wm, $$Wy > Wc \quad (1)$$

$$Wy > Wm \quad (2).$$

2. The full-color toner set according to claim 1 wherein the resin fine particles are copolymers comprising an acrylate monomer having an isobornyl group and a styrene monomer.

3. The full-color toner set according to claim 1 wherein a value of Wy/Wc is in a range from 1.1 to 5.0.

4. The full-color toner set according to claim 1 wherein a value of Wy/Wm is in a range from 1.1 to 5.0.

5. An image forming method comprising the steps of:

charging a image carrier by a charging unit;

forming an electrostatic image on the charged latent image carrier by an exposing unit;

developing the electrostatic latent image to a toner image with a developer from a developing unit;

and transferring the toner image to a recording medium by a transferring portion, wherein a toner set comprising a yellow component, a cyan component, and a magenta component is used as the developer, wherein each component comprises resin fine particles are externally added to a surface of base particles, wherein the yellow component comprises a monoazo pigment; and wherein formulae (1) and (2) are satisfied, where the amount of the resin fine particles based on 100 parts by mass of base particles in the yellow component is represented by Wy, the amount of the resin fine particles based on 100 parts by mass of base particles in the cyan component is represented by Wc, and the amount of the resin fine particles based on 100 parts by mass of base particles in the magenta component is represented by Wm, $$Wy > Wc \quad (1)$$

$$Wy > Wm \quad (2).$$

6. The image forming method according to claim 5 wherein the resin fine particles comprises acrylate monomer having an isobornyl group and a styrene monomer.

7. The image forming method according to claim 5 wherein Wy/Wc is in a range from 1.1 to 5.0.

8. The image forming method according to claim 5 wherein Wy/Wm is in a range from 1.1 to 5.0.

9. An image forming apparatus comprising:

a image carrier;

a charging unit to charge the image carrier;

an exposing unit to form an electrostatic image on the image carrier by exposing the image carrier charged by the charging unit;

a developing unit to develop the electrostatic latent image, which is formed on the image carrier by the exposing unit, with a developer so as to convert the electrostatic latent image to a toner image; and a transferring portion to transfer the toner image on the image carrier to a recording medium, wherein a toner set comprising a yellow component, a cyan component, and a magenta component is used as the developer;

wherein each of the yellow component, the cyan component, and the magenta component comprises base particles and resin fine particles added to the base particles;

wherein the yellow component further comprises a monoazo pigment, and wherein an amount of charge of the yellow component is substantially the same as that of each of the cyan and the magenta components and, formulae (1) and (2) are satisfied, where the amount of addition of the resin fine particles based on 100 parts by mass of base particles in the yellow component is represented by Wy, the amount of addition of the resin fine particles based on 100 parts by mass of base particles in the cyan component is represented by Wc, and the amount of addition of the resin fine particles based on 100 parts by mass of base particles in the magenta component is represented by Wm, $$Wy > Wc \quad (1)$$

$$Wy > Wm \quad (2).$$

10. The image forming apparatus according to claim 9, wherein the resin fine particles are copolymers comprising an acrylate monomer unit having an isobornyl group and a styrene monomer unit.

11. The image forming apparatus according to claim 9 wherein Wy/Wc is in a range from 1.1 to 5.0.

12. The image forming apparatus according to claim 9 wherein Wy/Wm is in a range from 1.1 to 5.0.

13. A toner set configured to inhibit image deterioration during long-term printing comprising:

a yellow component comprising:

a monoazo pigment;

base particles; and resin fine particles configured to be added to at least a portion of an external surface of the base particles;

a cyan component comprising;

base particles; and resin fine particles;

a magenta component comprising:

base particles; and resin fine particles;

wherein an amount of charge of the yellow component is substantially the same as that of the cyan and the magenta components and, a value of the ratio (Wy/Wc) of an amount of the resin fine particles in the yellow component (Wy) to an amount of the resin fine particles in the cyan component (Wc) based on 100 parts by mass of base particles, falls within a range from 1.1 to 5.0.

14. The toner set of claim 13, a value of the ratio (Wy/Wm) of an amount of the resin fine particles in the yellow component (Wy) to an amount of the resin fine particles in the magenta component (Wm), based on 100 parts by mass of base particles, falls within a range from 1.1 to 5.0.

15. The toner set of claim 13, wherein the yellow component further comprises titanium oxide.

16. The toner set of claim 13 wherein degradation of a charge maintaining characteristic of the yellow component of the toner is inhibited.

* * * * *